United States Patent [19]

Billon et al.

[11] Patent Number: 4,533,462

[45] Date of Patent: Aug. 6, 1985

[54] PROCESS FOR THE TREATMENT OF HIGHLY VISCOUS HEAVY OILS AT THE OIL FIELD TO EFFECT DESALTING AND TRANSPORTABILITY THEREOF

[75] Inventors: Alain Billon, Orlienas; Jean-Pierre Peries, Mornant; Alain Quignard, Rillieux-La-Pape, all of France

[73] Assignee: Institut Francais du Petrole, Rueil-Malmaison, France

[21] Appl. No.: 568,761

[22] Filed: Jan. 6, 1984

[30] Foreign Application Priority Data

Jan. 7, 1983 [FR] France ..... 83 00304

[51] Int. Cl.[3] ..... C10C 33/00; C10G 45/00; C10G 67/00

[52] U.S. Cl. ..... 208/88; 208/107; 208/370

[58] Field of Search ..... 208/88, 107, 370, 188

[56] References Cited

U.S. PATENT DOCUMENTS

| | | | |
|---|---|---|---|
| B 499,370 | 3/1976 | Merrill, Jr. | 208/370 |
| 1,661,565 | 3/1928 | Edeleanu | 208/88 |
| 2,425,532 | 8/1947 | Hemminger | 208/88 |
| 2,695,264 | 11/1954 | Toff et al. | 208/88 |
| 2,733,192 | 1/1956 | Sage | 208/88 |
| 2,785,120 | 3/1957 | Metcalf | 208/88 |
| 3,369,992 | 2/1968 | Henke et al. | 208/307 |
| 3,532,618 | 10/1970 | Wunderlich et al. | 208/107 |
| 4,172,026 | 10/1979 | Jensen | 208/370 |
| 4,298,457 | 11/1981 | Oblad et al. | 208/107 |
| 4,368,113 | 1/1983 | Winter et al. | 208/88 |
| 4,389,303 | 6/1983 | Simo et al. | 208/107 |
| 4,405,442 | 9/1983 | Deschamps et al. | 208/107 |
| 4,425,224 | 1/1984 | Vernon et al. | 208/107 |

*Primary Examiner*—D. E. Gantz
*Assistant Examiner*—Helane Myers
*Attorney, Agent, or Firm*—Millen & White

[57] ABSTRACT

A treatment of highly viscous and very dense oils at the oil field to effect their desalting, and resulting in the production of an easily transportable hydrocarbon mixture of reduced viscosity, comprising the steps of:

(a) diluting the crude oil with a hydrocarbon cut obtained in step (d);

(b) subjecting the effluent from step (a) to a desalting-dehydration treatment;

(c) subjecting the effluent from step (b) to hydrovisbreaking; and (d) distilling the effluent from step (c), and recycling a hydrocarbon cut to step (a), the remaining part forming a synthetic crude oil of reduced viscosity.

11 Claims, 1 Drawing Figure

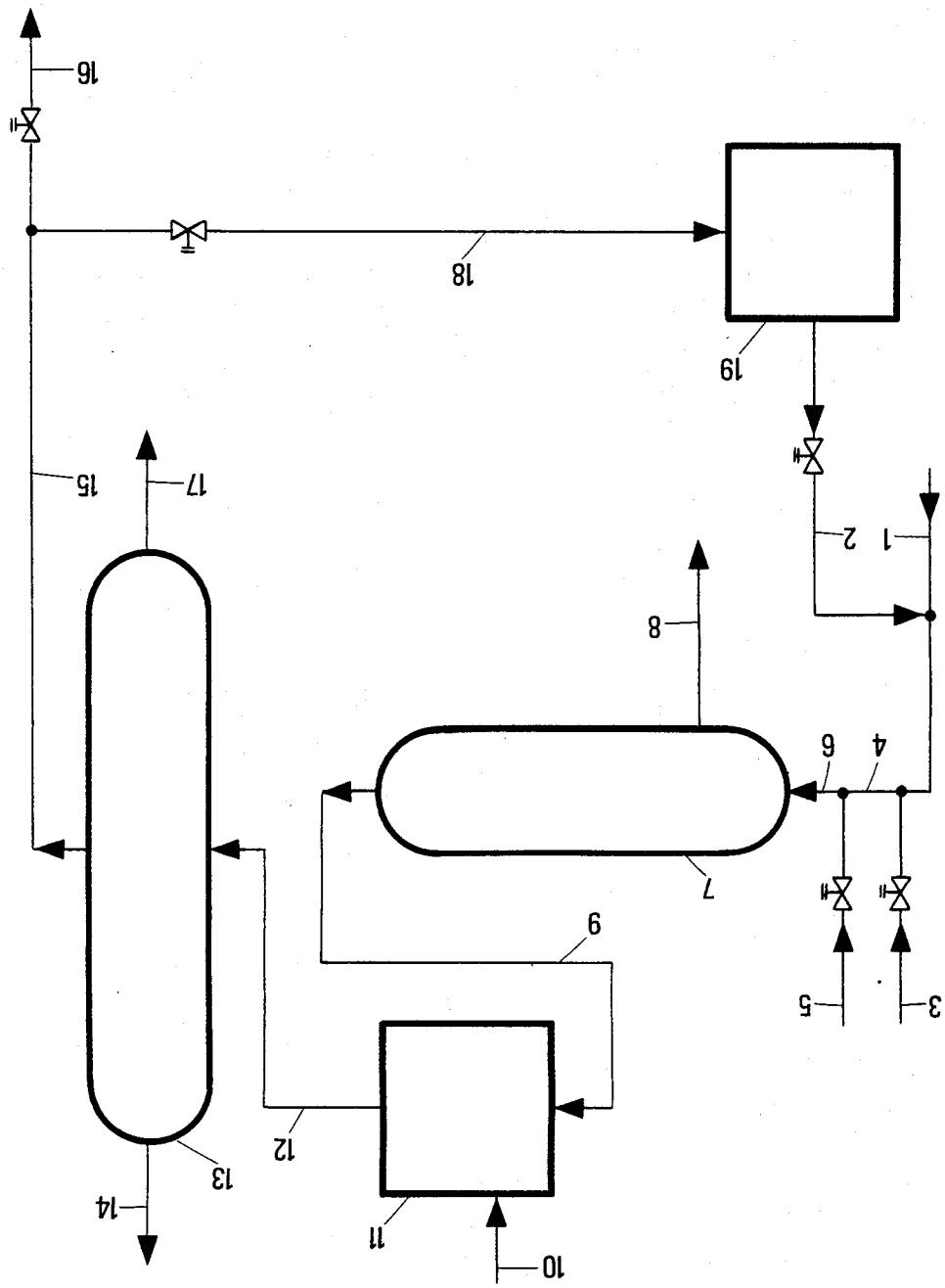
1
2
3
4
5
6
7
8
9
10
11
12
13
14
15
16
17
18
19

PROCESS FOR THE TREATMENT OF HIGHLY VISCOUS HEAVY OILS AT THE OIL FIELD TO EFFECT DESALTING AND TRANSPORTABILITY THEREOF

BACKGROUND OF THE INVENTION

This invention relates to a process for the treatment, at the oil field, of highly viscous and dense heavy oils, to produce an easily transportable mixture of hydrocarbons of reduced viscosity. The invention also has for an object to facilitate the desalting of heavy oils in the field by decreasing their viscosity and their density by addition of a hydrocarbon cut obtained at the oil field.

Today, one of the limiting factors in the development of the production of heavy oils of high density ($d_4^{15}$ higher than 0.98, i.e. an API degree lower than 12.9) and very high kinematic viscosity ($\eta_{100°\ C.} > 50$ cSt ($mm^2/s$), $\eta_{37.8°\ C.} > 1940$ cSt ($mm^2/s$)), is that of their transportation from the production zones to the refining locations.

As a matter of fact, although accurate specifications do not exist for the transportation by pipe-line, in accordance with the usually admitted rules, the kinematic viscosity must not exceed 120 cSt ($mm^2/s$) at 20° C. (a value retained for the South-European pipe-line), or must be lower than 400 cSt ($mm^2/s$) at 37.8° C., which is the admitted value in Venezuela, a country having substantial resources of heavy oils. It is observed that the viscosity at 37.8° C. of the heavy oils from Venezuela is mostly higher than 10,000 cSt ($mm^2/s$); examples thereof are Boscan: 18,600 cSt ($mm^2/s$), Laguna Once: 10,700 cSt ($mm^2/s$) and Cerro Negro (35 800 cSt): these values are thus substantially higher than the above limits and these heavy oils cannot be transported as such through pipe-lines.

Various attempts have been made to solve this problem of transporting highly viscous oils; examples thereof are:

1. Heating of pipelines; this solution is very costly, especially where the production fields are far from the refineries.
2. Transportation of heavy oils as oil-in-water stable emulsions; this technology, also very costly, since it results in the transportation of about 30 to 40% of water, suffers from additional disadvantages, such as the necessary demulsification after delivery from the pipeline.
3. Dilution of heavy oils, either with a light or middle crude oil or with middle distillates of low viscosity. In both cases, the problem of transporting dilution agents from their production area to heavy oil fields arises, with the necessary consequence of an additional cost.

As concerns the desalting of heavy and viscous crude oils in the field, other problems arise; the electrostatic desalters which can be used for desalting these oils are adapted to operate efficiently at dynamic viscosity levels not exceeding 4 to 5 mPa.s at the operating temperature, generally from 60° to 150° C. A great number of heavy and viscous oils exceed this limit to a very large extent; thus, Boscan crude oil has, at 150° C., a dynamic viscosity of 32 mPa.s. On the other hand, the settling rate of both oil and water phases in the desalter is proportional to the difference in density of the two phases. This difference is very small for most of the heavy crude oils. Thus, at 150° C., the difference in density between Boscan crude oil and water is only 0.09.

These problems of heavy oils desalting may be solved by the above solution (3), but it is apparent that there is place on the market for a process for treating heavy and viscous oils in the field, providing in situ a hydrocarbon cut of low viscosity and middle density, usable as dilution agent for the crude oil in order to permit its desalting in the field as well as its transportation.

Among the proposals made up to now for this type of process, there can be mentioned U.S. Pat. No. 3,474,596 (U.S. Pat. No. Re. 27,309), as well as French Pat. No. 2,489,835. The process disclosed in these two patents is crude oil visbreaking in the absence of hydrogen.

French Pat. No. 2,489,835 discloses a process for the pretreatment of predesalted heavy crude oils, comprising visbreaking, followed with distillation for separating two fractions: a synthetic transportable crude oil, obtained with a yield of 66 to 75%, and a non-transportable residue.

U.S. Pat. No. 3,474,596 (U.S. Pat. No. Re. 27,309) concerns a process wherein visbreaking is performed on a portion of the crude charge, after desalting, and the visbroken product is recycled in admixture with the crude oil before desalting.

This process, applied to oils having an API degree from 14 to 24 (i.e. densities $d_4^{15}$ from 0.972 to 0.910) would result in the production of a mixture of transportable hydrocarbons, and in the desalting in the field of the crude oils.

However, it has been observed that the visbreaking treatments effected in the absence of hydrogen lead to hydrocarbon mixtures whose heavier fractions have a poor stability, which can result in settling of a portion of said fractions and more particularly of asphaltenes, mainly during the transportation or the storage thereof.

SUMMARY OF THE INVENTION

The process of the present invention comprises the following steps:

a/ The crude oil, optionally after conventional degassing, when necessary, is diluted with a hydrocarbon cut of low viscosity obtained in step (d) of the process, in such a proportion that the dynamic viscosity of the resultant mixture is lower than 8 mPa.s at 150° C., and preferably lower than 5 mPa.s at 150° C.;

b/ The resultant mixture from step (a) is subjected to at least partial conventional desalting/dehydration. This can be effected by water addition in a proportion of water to oil generally from 3 to 6%, in order to form a water-in-oil emulsion facilitating the desalting operation, this emulsion being broken by coalescence in an electrostatic desalter (or desalters) where the two phases separate with oil desalting, optionally in the presence of a demulsifying agent;

c/ The desalted and dehydrated oil mixture from step (b) is subjected to hydrovisbreaking under conditions such that the conversion of the 380° C.+ fraction of the hydrovisbreaking charge to a 380° C.− fraction is from 10 to 30% and preferably from 15 to 25%;

d/ A hydrocarbon cut of low viscosity is separated by distillation of the product from step (c) and is fed back to step (a), the remaining part of the product from step (c) forming a synthetic crude oil of reduced viscosity, more easily transportable than the initial crude oil. Its kinematic viscosity is easily below 400 cSt ($mm^2/s$) at 37.8° C.

BRIEF DESCRIPTION OF THE DRAWING

The FIGURE is a schematic flow diagram illustrating an embodiment of the process of the invention.

DETAILED DISCUSSION

Examples of crude oils which can be used according to the invention are the crude oils of density ($d_4^{15}$) higher than 0.965, i.e. of API degree lower than 15, and of kinematic viscosity higher than 50 cSt ($mm^2/s$) at 100° C., as well as oils from shales or bituminous sands and asphalts having the preceding characteristics.

The hydrovisbreaking step (c) of the process consists of decreasing the oil viscosity to the maximum extent compatible with its stability; this means that the distillation residue obtained in step (d) of the process, normally boiling above 380° C., must be considered as stable according to ASTM standard D 1661.

The selection of the operating conditions may result from systematic experimentation by those skilled in the art. With this provision, the temperature usually ranges from 420° to 490° C., preferably from 440° to 460° C., the pressure being from 40 to 200 bars and preferably from 70 to 110 bars, the residence time being from 10 seconds to 15 minutes, preferably from 5 to 10 minutes; the operation is preferably conducted with a residence time in the hydrovisbreaking furnace from about 10 seconds to one minute, the reaction being optionally completed in a soaking chamber.

The hydrogen amount is usefully from 200 to 3000 $Nm^3/m^3$ of liquid charge and preferably from 300 to 1000 $Nm^3/m^3$.

Depending on the type of crude oil to be treated and more particularly on its viscosity, it may be convenient, during the distillation of step (d) of the process, to form cuts at various temperatures in order to obtain a cut whose characteristics are adapted for use in step (a) of the process.

In particular, the type and the amount of this cut (or cut fraction) which will be re-admixed with the crude oil must be such that:

This cut does not produce, in any case, a precipitation of solid fractions such, for example, as asphaltenes. Accordingly, a too high proportion of light hydrocarbons such as $C_7$ or lower, must be avoided.

The viscosity of the crude oil is decreased very substantially; the dynamic viscosity of the mixture of crude oil with the recycled cut will not exceed, at a maximum temperature of 150° C., 8 mPa.s. Accordingly, a too high proportion of heavy hydrocarbons must be avoided.

In addition, this cut must be of such a type that it contains at least 50% by weight and preferably at least 80% by weight of constituents normally distilling between 100° and 380° C.

Various hydrocarbon cuts resulting from the distillation of step (d) of the process perfectly fullfil these requirements; for example, there can be used as diluent of the crude charge such cuts as the 130° C.-380° C. cut, the initial distillation point—300° C. cut, etc.; the selection of the cut depending obviously on the type of crude oil to be treated, as well as on the amount of cut to be admixed with the heavy oil. The dynamic viscosity of these cuts will preferably be from 0.2 to 0.8 mPa.s at 150° C., and their density at this temperature preferably from 0.68 to 0.82.

At the beginning of the operation, it is necessary to dilute the crude oil with a hydrocarbon—or preferably with a hydrocarbon mixture—from an external source, placed in a storage tank. This hydrocarbon mixture must comply with the above-mentioned requirements concerning the recycled cut; in addition, its distillation range must be selected within the range of the cut selected for recycling. For example, middle distillates e.g. gas-oil or fuel-oils, or highly aromatic hydrocarbon fractions, may be used.

In order to facilitate the desalting of the oil, a certain amount of water is usually added to the oil, in a proportion of from 3 to 6% by weight with respect to the oil, so as to generate a water-in-oil emulsion. In the process of the invention this water addition is preferably performed after dilution of the crude oil with the recycled cut, through a mixing valve.

The coalescence of the emulsion within the desalter is often speeded up by the addition of a chemical agent having demulsifying properties; this addition may be effected either in the desalter itself or in the line conveying the already formed emulsion, before the desalter.

The accompanying drawing illustrates the process of the invention:

The crude oil charge, degassed according to a conventional process, not shown in the drawing, is supplied through line (1); it is diluted with a hydrocarbon mixture withdrawn from tank (19) through line (2). At the beginning of the operation, this dilution is effected with a hydrocarbon mixture from an external source; during the operation, the tank is fed through line (18) which conveys a portion of the distillation cut (15) selected for being recycling and used as diluent for the crude oil (in the flow diagram it consists of a middle cut). The excess of this cut is discharged through line (16) to form a part of the synthetic crude oil.

Water in small proportion is added to the dilute crude oil through line (3) by means of a mixing valve, to form a water-in-oil emulsion (line 4). A demulsifying agent is optionally added through line (5) before supply through line (6) to the one or more desalter(s) referred to as (7).

The salted water is discharged through line (8); the diluted, desalted and dehydrated oil is conveyed through line (9) to a hydrovisbreaking unit (11), hydrogen being introduced through (10).

The hydrovisbreaking effluent is conveyed through line (12) to the distillation unit (13). At the top (14) of said column, the gas and, for example, the 130° C.− light fraction are separated. The 130° C.-380° C. fraction is withdrawn through line (15), one portion thereof being recycled through line (18) for diluting the crude oil and the other portion discharged through line (16). The heavy fraction such as, for example, the 380° C.+ fraction, is discharged through line (17) from the bottom of the column.

The mixture of the liquid fractions obtained in lines (14), (16) and (17) constitutes a transportable synthetic crude oil.

According to the process of the invention, which comprises a moderate hydrovisbreaking step as previously defined, a synthetic crude oil is obtained under steady running conditions with a yield of 95 to 98% by weight with respect to the heavy oil charge.

It is thus easy to obtain a synthetic crude oil having a kinematic viscosity lower than 400 cSt ($mm^2/s$) at 37.8° C.; more particularly the values of the kinematic viscosities of the synthetic crude oils obtained from the above-defined heavy oils are easily lower than 300 cSt ($mm^2/s$) at 37.8° C., i.e. clearly lower than the maximum value accepted in Venezuela for the transportation of oils through pipelines.

Apart from the improvement in the transportation conditions, it must be noted that the distillates obtained from these synthetic crude oils do not substantially differ from the distillates obtained from a natural crude oil; however the asphaltenes and sulfur contents are lowered, which makes the prerefining operations (deasphalting, desulfuration) easier.

Example illustrating the process of the invention:

The treated charge is a Boscan crude oil, whose main characteristics are as follows:

Density $d_4^{15}=0.998$
API degree=10.3
Kinematic viscosity at 37.8° C.=18 600 cSt ($mm^2/s$)
Kinematic viscosity at 150° C.=35.3 cSt ($mm^2/s$)
Dynamic viscosity at 150° C.=32.2 mPa.s
Sulfur content by weight=5.3%
Asphaltenes content by weight (determined with n-heptane)=12.6%
Water content by volume=3%
Salts content (expressed in mg/l of NaCl)=900 mg/l
Distillation (% by weight): initial point (140° C.)-380° C.=17.9%; 380° C.+=82.1%

At the beginning of the operation, 100 parts of this crude oil, after degassing, are added to 40 parts by weight of a total gas-oil cut, supplied from an external source, stored in a storage tank, referred to as (19) in the figure illustrating the process.

This cut has the following characteristics: boiling range: 230°-350° C.; density $d_4^{15}=0.837$; kinematic viscosity at 37.8° C.: 3.25 cSt ($mm^2/s$); density $d_{150}^{150}=0.749$; kinematic viscosity at 150° C.: 0.69 cSt ($mm^2/s$).

The resultant mixture has a dynamic viscosity of 3.86 mPa.s at 150° C.; its density with respect to water at the same temperature is 0.859.

7.0 parts by weight of soft water are added to this mixture through line (3), thus amounting to 5% by weight of the mixture. Before supplying the resultant water-in-oil emulsion to the electrostatic desalter, a non-ionic demulsifying agent (copolymer of ethylene oxide with propylene oxide) is added thereto in a proportion of 0.01 part by weight of demulsifying agent per 100 parts of emulsion.

Desalting is performed in two serially arranged electrostatic desalters at 150° C., the electric field being 1000 V/cm and the residence time of the emulsion 30 minutes in each desalter, the pressure being 6 bars. After settling of the aqueous phase, the water content of the oil mixture is, by volume, about 0.5% and the salts content, expressed in mg/l of NaCl, is generally lower than 50 mg/l.

The resultant dehydrated and desalted oil mixture is then subjected to a hydrovisbreaking treatment in the following conditions:

Temperature: 440° to 460° C.
Pressure: 100 bars
Ratio by volume of $H_2$ to the hydrocarbon charge: 500 $Nm^3/m^3$
Total residence time: 8 minutes comprising one minute under the furnace and 7 minutes in the soaker.

The hydrovisbreaking effluent is then distilled under normal pressure to give the two following cuts: 130° C.−, 130° C.-380° C., and a 380° C.+ residue.

From the 130° C.-380° C. cut, 40 parts by weight per 100 parts of treated crude oil are recycled to the storage tank; these 40 parts are used as diluent for 100 parts of crude oil charge, the remaining part of the cut being recovered.

When the unit operates in steady running conditions, the 130°-380° C. cut amounts to 70.01 parts per 100 parts of crude oil and 40 parts of diluent. Thus, 57.13% by weight of said cut are recycled and the remaining part of the cut, i.e. 42.87%, the 130° C.− distillates and the 380° C.+ residue are recovered.

Under steady running conditions, the density of the mixture of crude oil with the diluent (130° C.-380° C. cut) is 0.847 at 150° C. The dynamic viscosity of the oil phase in the desalters is 4.84 mPa.s at 150° C.

After separation of the gas from the 130° C.− cut, the following distillates are recovered in the following amounts, expressed in parts per 100 parts of crude oil:

| | | |
|---|---|---|
| $H_2S + NH_3$ | = 1.53 parts | 35.25 parts |
| $C_1$-$C_4$ | = 1.21 parts | |
| PI - 130° C. | = 2.50 parts | |
| 130-380° C. | = 30.01 parts | |
| 380° C.+ | = 64.75 parts | |

The 380° C.− fraction thus increases from 17.9 parts per 100 parts in the crude oil to 35.25 parts per 100 parts in the distillates obtained after the hydrovisbreaking treatment, thus corresponding to the formation of 17.35 parts from 82.1 parts of the 380° C.+ fraction, i.e. a conversion by weight of 21.1% of said fraction.

The different liquid fractions separated from reconstituting the synthetic crude oil have the following physical characteristics:

| | |
|---|---|
| Initial point (60° C.)-130° C.: | $d_4^{15}$ = 0.690, |
| kinematic viscosity at 37.8° C.: | 0.5 cSt ($mm^2/s$) |
| 130° C.-380° C. cut: | $d_4^{15}$ = 0.881; $d_{150}^{150}$ = 0.792 |
| kinematic viscosity at 37.8° C.: | 3.53 cSt ($mm^2/s$) |
| kinematic viscosity at 150° C.: | 0.83 cSt ($mm^2/s$) |
| 380° C.+ residue: | $d_4^{15}$ = 1.031, |
| kinematic viscosity at 37.8° C.: | 240 000 cSt ($mm^2/s$). |

These three separate fractions are mixed to form a synthetic crude oil with a yield of 97.26% by weight with respect to the treated crude oil. The composition of this synthetic crude oil, expressed in proportions by weight is:

| | |
|---|---|
| 60° C.-130° C. cut = | 2.57% |
| 130° C.-380° C. cut = | 30.86% |
| 380° C.+ residue = | 66.57% |
| | 100.00 |

The characteristics of this synthetic crude oil are as follows:

Density: $d_4^{15}=0.968$
API degree: 14.7
Kinematic viscosity at 37.8° C.: 169 cSt ($mm^2/s$)
Kinematic viscosity at 100° C.: 12.6 cSt ($mm^2/s$)
Sulfur content by weight: 4.4%
Asphaltenes content by weight (determined with n-heptane): 10.4%
Water content (by volume): 0.5%
Salts content (expressed in mg/l de NaCl): 25 mg/l A comparison of the characteristics of the crude oil with those of the reconstituted synthetic crude oil, shows that:

The density has been slightly decreased,

The kinematic viscosity has been decreased to a considerable extent, making possible the transportation of the synthetic crude oil, at least in compliance with the Venezuelian standards, The sulfur and asphaltene contents by weight have been decreased, thus facilitating the pre-refining operations, The water and salts contents are such that the resultant synthetic crude oil may be directly subjected to the pre-refining operations.

COMPARATIVE EXAMPLE

When the same crude oil is subjected to visbreaking in the absence of hydrogen according to conditions similar to those of the example of the invention, by previously diluting the crude oil, in the same manner as in the preceding example, with a portion of the 130°-180° C. cut, substantially similar results are obtained as far as the desalting and the dehydration of the crude oil are concerned.

The proportions of the recovered fractions, expressed in parts per 100 parts of crude oil, are as follows:

$H_2S+NH_3$: 1.3 parts
$C_1$-$C_4$: 1.5 parts
PI-130° C.: 2.5 parts
130° C.-380° C.: 27.8 parts
380° C.+: 66.9 parts The synthetic crude oil, reconstituted from the recovered liquid effluents, has the following composition, in percents by weight:

PI-130° C.: 2.57%
130° C.-380° C.: 26.80%
380° C.+: 68.82%

The kinematic viscosity of this reconstituted synthetic crude oil is 460 cSt ($mm^2/s$) at 37.8° C., which is not in compliance with the transportation standards in Venezuela.

What is claimed as the invention is:

1. A process for the treatment, at the production field, of a highly viscous crude oil, containing salt and water, in order to convert it to an oil of lower viscosity and lower salt and water contents, said process comprising the steps of:

(a) diluting the crude oil with a hydrocarbon cut of low viscosity obtained in step (d), in such a proportion that the dynamic viscosity of the resultant mixture is 0.2-0.8 mPa.s at 150° C. and its density is 0.68-0.82 g/ml at 150° C.;

(b) subjecting the resultant diluted oil from step (a) to at least partial desalting and at least partial dehydration;

(c) subjecting the desalted and dehydrated oil diluted with said hydrocarbon cut of low viscosity from step (b) to hydrovisbreaking, in the presence of hydrogen, at a temperature of 420°-490° C., a pressure of 40-200 bar, a total residence time from 10 seconds to 15 minutes in a reaction furnace and soaking chamber, and a ratio of the normalized volume of hydrogen to the volume of the desalted and dehydrated oil of 200-3,000; and converting 10 to 30% of the 380° C.+ fraction of the hydrovisbreaking charge to a 380° C.− fraction; and (d) distilling the effluent from step (c), and separating a hydrocarbon cut having a kinematic viscosity below 400 cSt. at 37.8° C., at least 50% by weight of which normally distills between 100° and 380° C., feeding at least a portion thereof back to step (a), and combining the remaining liquid distillation effluents to form a synthetic crude oil of reduced viscosity and low salt and water contents.

2. A process according to claim 1, wherein the heavy oil charge has a density ($d_4^{15}$) higher than 0.965 and a kinematic viscosity higher than 50 cSt ($mm^2/s$) at 100° C.

3. A process according to claim 1, wherein in step (b), the mixture obtained from step (a) is subjected to desalting and dehydration, in at least one electrostatic desalter, at such a temperature that the dynamic viscosity of the mixture does not exceed 8 mPa.s.

4. A process according to claim 3, wherein said temperature is such that the dynamic viscosity of the mixture is lower than 5 mPa.s.

5. A process according to claim 1, wherein the conversion rate of the 380° C.+ fraction of the hydrovisbreaking charge to a 380° C.− fraction is from 15 to 25%.

6. A process according to claim 1, wherein the hydrovisbreaking treatment in step (c) comprises passing the desalted and dehydrated mixture through a hydrovisbreaking furnace for a period of from 10 seconds to 1 minute.

7. A process according to claim 1, wherein the cut separated in step (d) and fed back to step (a) consists of a hydrocarbon mixture at least 80% by weight of which normally distills between 100° and 380° C.

8. A process according to claim 1 wherein in step (c), the hydrovisbreaking is effected at a temperature of 440°-460° C., a pressure of 70-100 bar, a residence time of 5-10 minutes, and a normal hydrogen volume/liquid charge volume ratio of 300-1,000.

9. A process according to claim 8, wherein the residence time in the hydrovisbreaking furnace is from about 10 seconds to one minute.

10. A process according to claim 1, wherein the yield of synthetic crude oil produced in step (d) is 95-98% by weight, with respect to the heavy crude oil charge to step (a).

11. A process according to claim 1, wherein said kinematic viscosity is below 300 cSt. at 37.8° C.

* * * * *